US009505511B2

(12) United States Patent
Murray

(10) Patent No.: US 9,505,511 B2
(45) **Date of Patent: *Nov. 29, 2016**

(54) DIVING NOZZLE FOR FILLING A PRODUCT INTO A PACKAGE AND FOR GAS PURGING AND METHOD FOR THE SAME

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/971,269

(22) Filed: Dec. 16, 2015

(65) Prior Publication Data

US 2016/0096644 A1 Apr. 7, 2016

Related U.S. Application Data

(63) Continuation-in-part of application No. 14/032,606, filed on Sep. 20, 2013, now Pat. No. 9,242,848.

(60) Provisional application No. 61/703,328, filed on Sep. 20, 2012.

(51) Int. Cl.

| | |
|---|---|
| ***B65B 39/04*** | (2006.01) |
| ***B65B 3/18*** | (2006.01) |
| ***B65B 31/04*** | (2006.01) |
| ***B65B 39/12*** | (2006.01) |
| ***B65B 39/14*** | (2006.01) |
| ***B67D 7/42*** | (2010.01) |
| ***B65B 3/04*** | (2006.01) |

(52) U.S. Cl.

CPC ..... *B65B 39/04* (2013.01); *B65B 3/04* (2013.01); *B65B 3/18* (2013.01); *B65B 31/044* (2013.01); *B65B 39/12* (2013.01); *B65B 39/145* (2013.01); *B67D 7/42* (2013.01)

(58) Field of Classification Search

CPC ..... B67D 7/42; B65B 31/044; B65B 39/12; B65B 39/145; B65B 3/04

USPC ..... 141/57, 59, 64, 263, 264, 279, 284, 374

See application file for complete search history.

(56) References Cited

U.S. PATENT DOCUMENTS

| | | | | |
|---|---|---|---|---|
| 3,181,576 | A | 5/1965 | Pellarino | |
| 4,530,202 | A | 7/1985 | Powell et al. | |
| 4,606,382 | A | 8/1986 | Biller et al. | |
| 4,749,010 | A | 6/1988 | Petell | |
| 5,758,698 | A | 6/1998 | Kaneko | |
| 6,155,314 | A | 12/2000 | Ding et al. | |
| 6,817,386 | B2 | 11/2004 | Tsukano et al. | |
| 7,730,912 | B2 | 6/2010 | Blichmann | |
| 9,242,848 | B2 * | 1/2016 | Murray | B67D 7/42 |
| 2002/0179177 | A1 | 12/2002 | Tsukano et al. | |
| 2005/0178466 | A1 | 8/2005 | Tanikawa et al. | |

* cited by examiner

*Primary Examiner* — Timothy L Maust
(74) *Attorney, Agent, or Firm* — Dinsmore & Shohl LLP

(57) ABSTRACT

The diving nozzle includes a first tube and a second tube. The first tube having a first inlet and a first outlet. The first inlet connected to a supply of a first material. The first outlet operable to dispense the first material into the package. The second tube is moveable with respect to the first tube. The second tube having a second inlet and a second outlet. The second inlet connected to a supply of a second material. The second outlet operable to dispense the second material into the package. The first material is one of the product and the purging gas, the second material is the other of the product and the purging gas.

11 Claims, 4 Drawing Sheets

DIVING NOZZLE FOR FILLING A PRODUCT INTO A PACKAGE AND FOR GAS PURGING AND METHOD FOR THE SAME

CROSS-REFERENCE TO RELATED APPLICATIONS

This application is a continuation-in-part application of U.S. Non-Provisional application Ser. No. 14/032,606 filed Sep. 20, 2013 which claims priority to U.S. Provisional Application Ser. No. 61/703,328 filed Sep. 20, 2012, which is incorporated herein by reference in the entirety.

TECHNICAL FIELD

The present specification relates to a diving nozzle. More particularly, the present specification relates to a diving nozzle capable of preforming a filling and a gas purging operation.

BACKGROUND

It is well known in the art to perform a purging operation after a package, such as a flexible pouch, has been filled with a variety of products including consumable liquids and other edible products. In order to extend the shelf life of the product in the flexible pouch, oxygen present in the pouch must be purged by an inert gas prior to the sealing of the flexible pouch. The presence of oxygen in the pouch increases the chance of a bacteria forming or may affect the taste of the consumable liquid or other edible products within the packaged pouch.

Previously known pouch filling and sealing machines included a separate gas flush or gas purge station positioned after a filling station. The separate gas purge station purged the interior of the pouch with the inert gas prior to the sealing of the pouch. However, there are several disadvantages of the previously known fill-seal machines which include a gas purge or flush station positioned between the filling station and the sealing station.

Specifically, the inclusion of a separate station of the fill-seal machine for the sole purpose of purging the interior of the pouch of oxygen decreases the operational efficiency of the fill-seal machine operation. The requirement for a separate station increases the overall time required for the flexible pouch to undergo the fill-seal operation. Moreover, the inclusion of a separate station for the purging operation increases the overall size of the fill-seal machine and reduces the number of pouches which can undergo simultaneous operation at each station.

Moreover, by conducting the purging operation at a separate station from the filling station requires that the pouch be displaced from the filling stage to the separate purge station. The movement of the pouch from the filling station to the purge station often disrupts product filled within the flexible pouch which may be splattered or otherwise adhered to the interior portion of the upper edge of the flexible pouch. The contamination of the upper edge of the pouch can decrease the effectiveness of a later applied seal that seals the upper edge of the pouch.

Thus, there exists a need in the art for a diving nozzle which overcomes the above mentioned disadvantages of the previously known flexible pouch filling systems.

SUMMARY

The present specification provides a diving nozzle for filling a package with a product and purging oxygen from the package at a single operation station.

In brief, the diving nozzle includes a first tube and a second tube. The first tube having a first inlet and a first outlet. The first inlet connected to a supply of a first material. The first outlet operable to dispense the first material into the package. The second tube is moveable with respect to the first tube. The second tube having a second inlet and a second outlet. The second inlet connected to a supply of a second material. The second outlet operable to dispense the second material into the package. The first material is one of the product and the purging gas, the second material is the other of the product and the purging gas.

The second tube is moveable with respect to the first tube so as to displace the second tube between an extended position and a retracted position. In the retracted position a distal end of the second tube is received within a distal end of the first tube to close the first outlet. Closing the first outlet prevents dispensing of the first material when the second tube is in the retracted position. In the extended position the second tube is displaced relative to the first tube to space the distal end of the second tube from the distal end of the first tube to open the first outlet of the first tube.

The distal end of the second tube is optionally formed having a stopper. The stopper seals the first outlet when the second tube is in the retracted position. The stopper includes a base portion having an outer diameter corresponding to an inner diameter of the distal end of the first tube. The stopper has a generally frustoconical shaped portion positioned above the base portion. When the second tube in in the extended position and the first material dispensed from the first outlet, the first material contacts the frustoconical shaped portion of the stopper to diffuse the first material into the package.

The diving nozzle optionally includes a vertical displacement mechanism that vertically displaces the diving nozzle between a raised position and a lowered position. In the raised position the distal end of the first tube and the distal end of the second tube is positioned above an open end of the package. In the lowered position a portion of the first tube and a portion of the second tube extend into the package.

The diving nozzle optionally includes an actuator having a shaft secured to the second tube. The actuator displaces the shaft to coaxially displace the second tube with respect to the first tube. The actuator is optionally a actuator having a piston slidingly received within a case. The shaft having one end secured to the second tube and an opposite end secured to the piston. The actuator operable to displace the second tube through a controlled ingress and egress of fluid into the case.

Upon displacement of the diving nozzle into the lowered position, by the vertical displacement mechanism, the second material is dispensed through the second outlet, and wherein upon movement of the diving nozzle from the lowered position towards the raised position and movement of the second tube from the retracted position to the extended position the first material is dispensed through the first outlet.

BRIEF DESCRIPTION OF THE DRAWINGS

Advantages of the present specification will be readily appreciated as the same becomes better understood by reference to the following detailed description when considered in conjunction with the accompanying drawings wherein.

DETAILED DESCRIPTION OF THE EMBODIMENTS

The present specification has utility as an apparatus that is capable of both filling a package with a product and performing a gas purge operation at a single station of a fill-seal machine. By providing a diving nozzle having a first tube connected to a supply of a first material and a second tube, which is moveable with respect to the first tube and connected to a second supply of material allows for a pouch to be filled and then undergo a gas purge operation at a single stage of a fill-seal machine.

Figure 1:
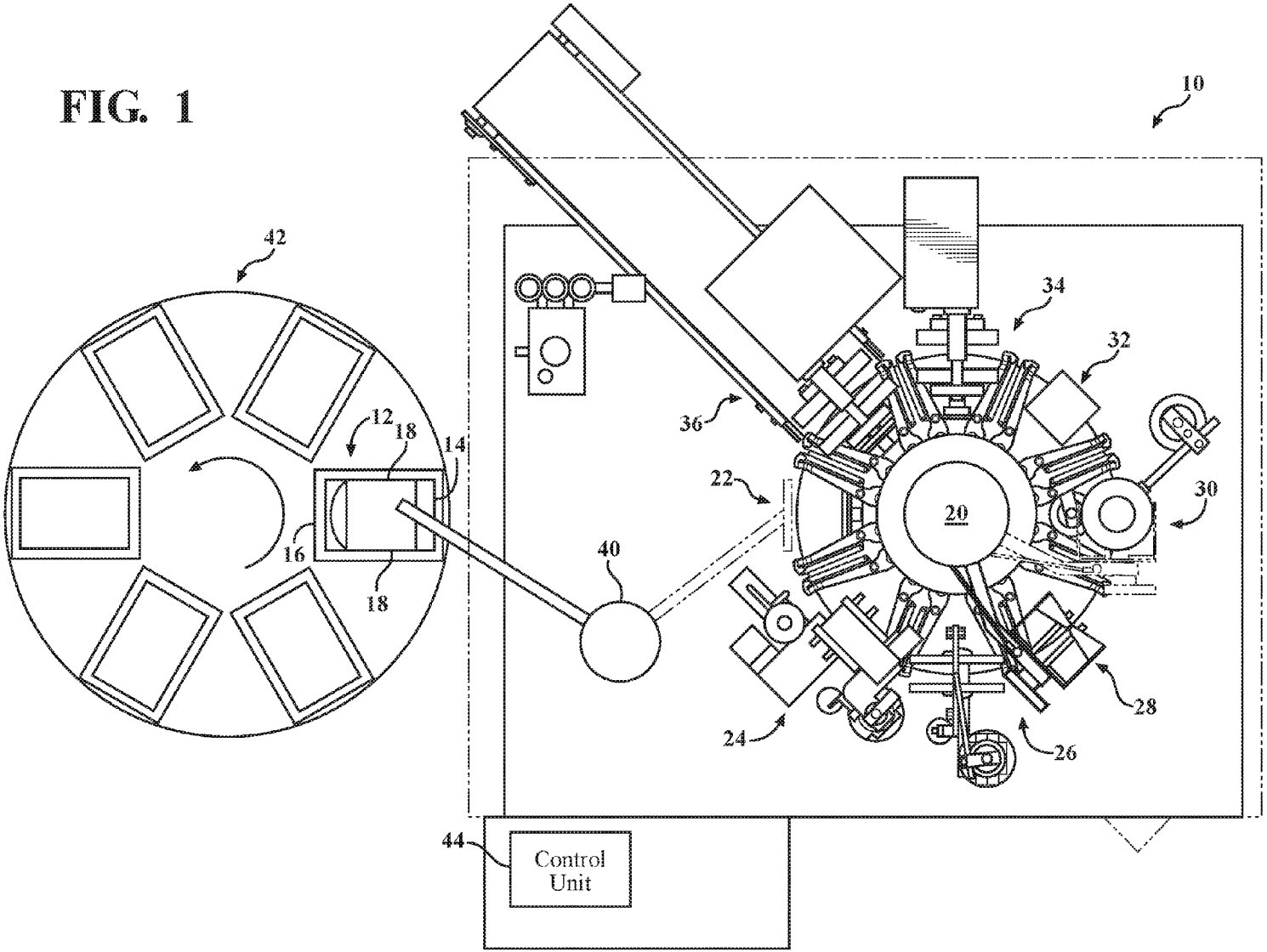
FIG. 1 is a schematic view of a fill-seal apparatus.

With reference to FIG. 1, an apparatus for filling and sealing packages is generally illustrated at 10. The apparatus is particularly adapted for consumable liquid products such as juice, carbonated beverages, and alcoholic beverages. However, it is appreciated, of course, that the diving nozzle is not limited to liquids or consumable products.

The apparatus 10 is configured to fill and seal a variety of packages such as flexible pouches 12 having a variety of different shapes. It is appreciated, of course, that the apparatus 10 is not limited to packages such as flexible pouches 12, and is operable to fill and seal a variety of different packages illustratively including cans, boxes, jars, bottles, rigid pouches and other similar packages.

Figure 3:
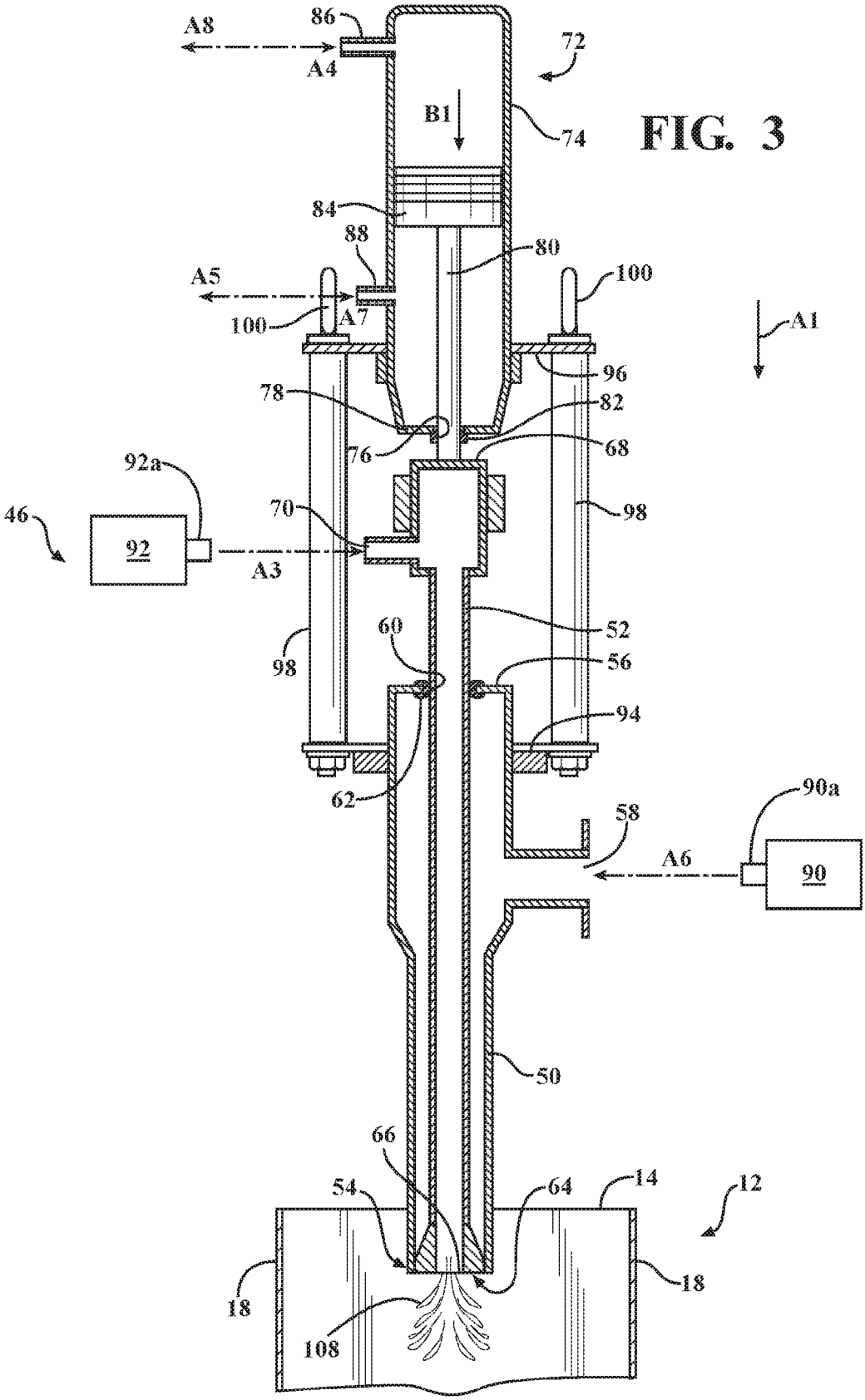
FIG. 3 is a partial cross-sectional view of the diving nozzle in the lowered position and the second tube in the retracted position.
Figure 4:
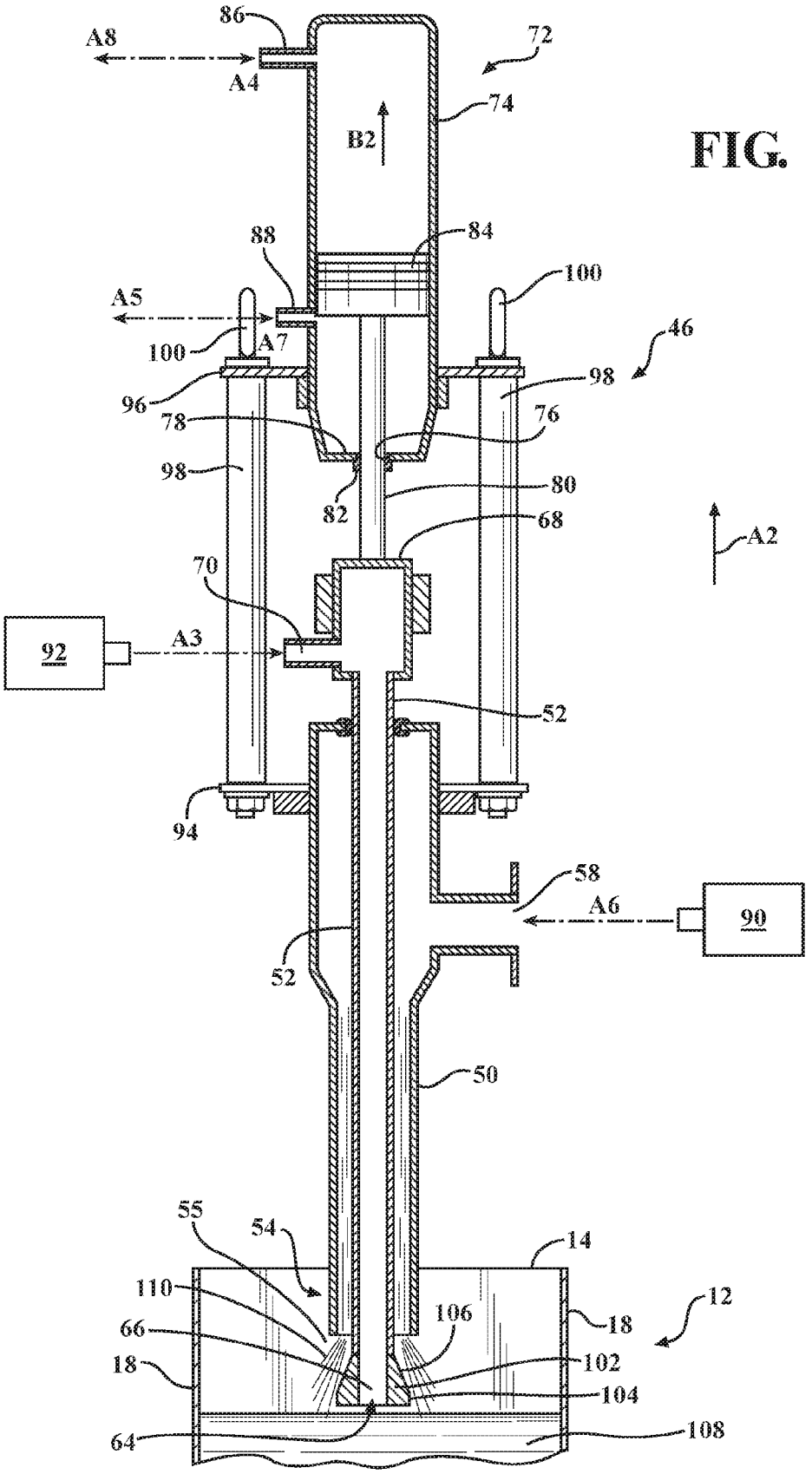
FIG. 4 is a partial cross-sectional view with the diving nozzle in the lowered position and the second tube in the extended position.

As seen in FIGS. 1 and 3-4, the pouches 12 include a top end 14, an opposite bottom end 16, and a pair of sides 18 extending between the top end and the bottom end 16. It is appreciated, of course, that the flexible pouches 12 may be formed from a single piece of material or two separate panels sealed together to form the pouch 12. In addition, the flexible pouches may include a variety of additional features including bottom or side gussets, fitments, and resealable zip type openings.

The top end 14 of each of the flexible pouches 12 defines an opening for filling, specifically, an open top end. In an example of the pouch 12 formed using two sheets of material, the side edges 18 may be joined along two side seams, such as a flat seam or a fin style seam, extending from the top end 14 to the bottom end 16. Moreover, the top end 14 may include a spout that defines the opening for filling.

As shown in FIG. 1, the apparatus 10 is a rotary fill-seal machine having a rotary turret 20, which is sequentially rotated in a counterclockwise direction through a plurality of stations or stages by a motor. It is appreciated, of course, that although the illustrated embodiment depicts the apparatus 10 for filling and sealing the flexible pouches 12 as a rotary machine, the present specification is not limited to such a configuration and is optionally a linear type fill-seal machine. Moreover, the present specification is not limited to a fill-seal configuration, and is optionally a fill machine in which pouches are then transferred to a separate machine for sealing.

The rotating turret 20 rotates through a plurality of stations in which the apparatus 10 performs an operation on a single pouch 12 or a plurality of pouches 12 simultaneously. The rotating turret 20 of the apparatus 10 includes a loading station 22, a first accessory station 24, a first opening station 26, a second opening station 28, a filling and gas purging station 30, a second accessory station 32, a sealing station 34, and a discharge station 36. Each of the stations 22-36 applies a specific operation on a single pouch 12 or a plurality of pouches. After completion of the operation, the rotating turret 20 rotates the pouches 12 to a subsequent station.

Figure 2:
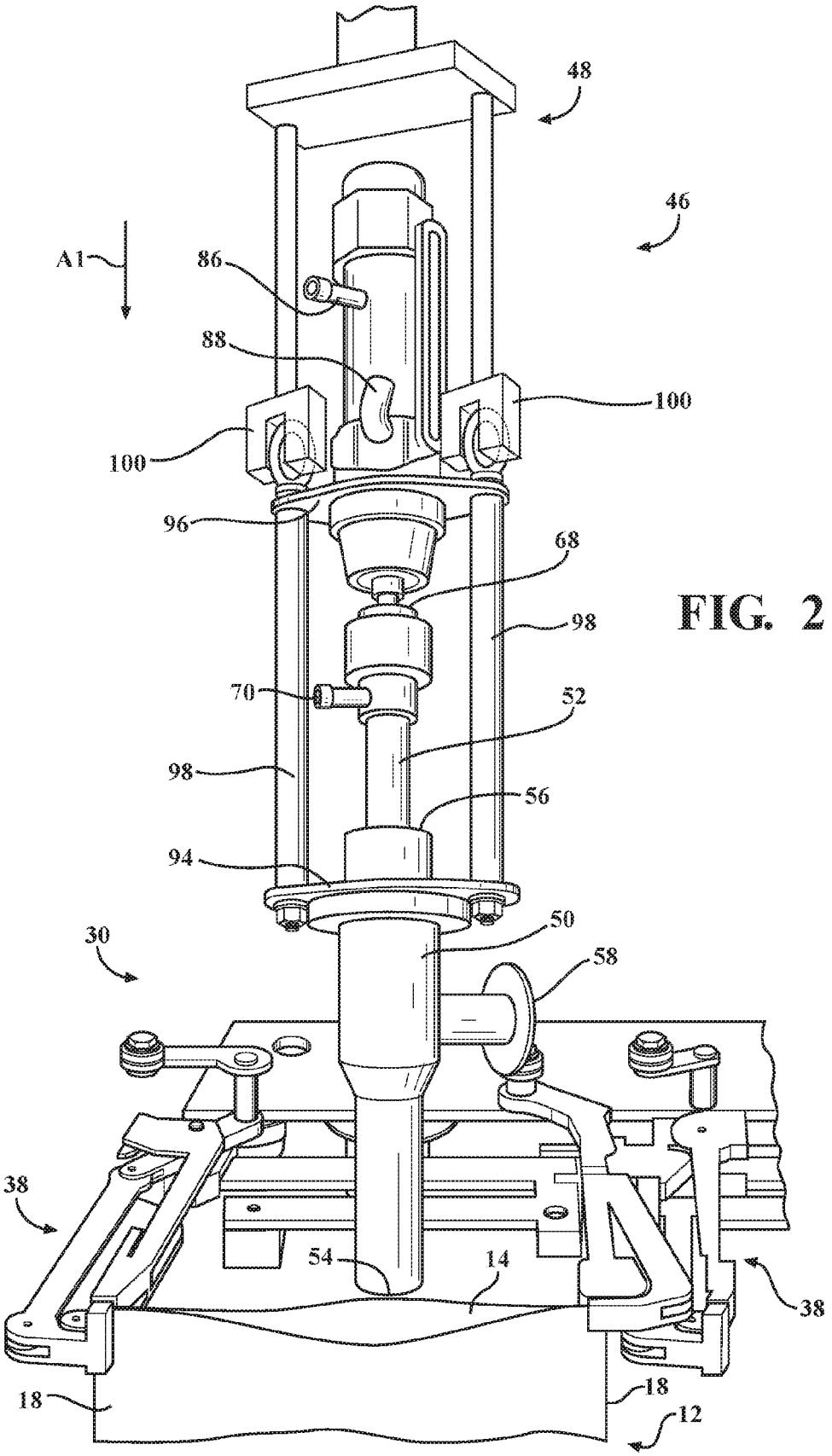
FIG. 2 is a perspective view of the inventive diving nozzle with the diving nozzle in the raised position and the second tube in the retracted position.

As best seen in FIG. 2, each of the stations of the rotating turret 20 includes at least one gripper pair 38 which hold the sides 18 of the pouches 12 to secure the pouch 12 therein. It is appreciated, of course, that at each of the stations, a multitude of gripper pairs 38 such as double, triple, or quadruple gripper pairs are provided. Moreover, at each of the stations, the operation performed thereon is applied to each of the pouches within the plurality of gripper pairs 38 so that each of the plurality of pouches 12 at each individual station undergoes the same operation simultaneously.

At the loading station 22, a robotic transfer device 40 transfers the pouches 12 from a pouch supply 42 into the open gripper pairs 38 at the loading station 22. After the pouch 12 has been received and gripped by the gripper pairs 38, the rotating turret 20 rotates the pouches 12 to the subsequent station. Specifically, the first accessory station 24 which applies a first accessory to the pouch 12, illustrating including indicia, spouts, zipper closures, RFID tags, and so on. The pouch 12 is initially opened at the first opening station 26 and is then rotated to the second opening station 28 in which the pouch is fully opened. Afterwards the opened pouch 12 is then rotated to the filling and purge station 30 in which the pouch 12 undergoes a filling operation and a gas purge operation by a single diving nozzle, which will be described in greater detail below.

Once the pouch 12 has been filled with a product and purged of any excess oxygen at the fill-purge station 30, the rotating turret 20 rotates the pouch 12 to the second accessory station 32 at which additional accessories are provided to the pouch 12. The open upper end or top end 14 is sealed at the sealing station 34 and the completed filled and sealed pouch 12 is discharged at the discharge station 36.

Operation of the apparatus 10 is controlled by an electronic control unit 44 which is in electronic communication with the rotating turret 20 so as to control all operations of the apparatus 10. The electronic control unit 44 includes a central processing unit, memory, and a communication bus so as to interface with the various components of the apparatus 10. Specific characteristics of the pouch 12 and the product to be filled therein can be stored in the storage device of the electronic control unit 44 so as to efficiently operate the apparatus 10.

With reference to FIG. 2, the inventive diving nozzle 46 will now be explained. The diving nozzle 46 is positioned at the fill-purge station 30 of the apparatus 10. The diving nozzle 46 allows for the pouch 12 to undergo a fill operation and a gas purge operation at a single station of the apparatus 10. The diving nozzle 46 is connected to a vertical displacement member 48 and suspended above the fill-purge station 30. The vertical displacement mechanism 48 vertically displaces the entire diving nozzle 46 in the direction of arrow A1 from the raised position as illustrated in FIG. 2 to the lowered position as illustrated in FIGS. 3 and 4. The vertical displacement mechanism 48 further raises the entire diving nozzle 46 from the lowered position to the raised position in the direction of arrow A2 as seen in FIG. 4.

In the raised position the diving nozzle 46 is positioned above the open top end 14 of the pouch 12, and in the lowered position a portion of the diving nozzle 46 is positioned below the top end 14 and into the interior of the pouch 12. In the raised position the diving nozzle 46 is positioned above the pouch 12 so as to allow for the pouches 12 to be rotated by the rotating turret 20. As such, the diving nozzle 46 and the vertical displacement mechanism 48 do not rotate with the rotating turret 20.

With reference to FIGS. 3 and 4, the diving nozzle 46 includes a first tube 50 and a second tube 52. The first tube 50 and the second tube 52 are formed as generally hollow cylindrical tubes. The second tube 52 is positioned so as to extend coaxially with the first tube 50. The second tube 52 at least partially extends within the first tube 50.

The first tube 50 includes an open distal end 54 and a closed end 56. A first inlet 58 is provided on the first tube 50 so as to provide a passage through the interior of the first tube 50 from the first inlet 58 to a first outlet 55. The first outlet 55 is formed at the open distal end 54 of the first tube 50 and will be described in greater detail below.

The upper end 56 of the first tube 50 includes an aperture 60 through which a portion of the second tube 52 extends. A resilient seal 62 is positioned within the aperture 60 so as to provide a fluid-tight seal between the top wall 56 and the second tube 52 while still allowing for relative movement of the second tube 52 with respect to the first tube 50.

The second tube 52 includes a distal end 64 having a second outlet 66 and an opposite end wall 68. A second inlet 70 is provided so as to provide a passageway through the hollow second tube 52 from the second inlet 70 to the port 66.

An actuator 72 is provided at the upper end of the diving nozzle 46. The actuator 72 provides for vertical displacement of the second tube 52 with respect to the first tube 50. Simply put, the actuator 72 vertically displaces only the second tube 52 while the first tube 50 remains stationary. The actuator 72 is optionally a fluid controlled actuator that converts fluid pressure into motion, such as a pneumatic actuator. The actuator 72 includes an actuator case 74. An aperture 76 is provided within the bottom wall 78 of the actuator case 74. A shaft 80 extends through the aperture 76 and is sealed by a resilient seal 82.

A lower end of the shaft 80 is connected to the end wall 68 of the second tube 52 and an upper end of the shaft 80 is connected to a piston 84. The piston 84 is positioned within the actuator housing 74 between a first port 86 and a second port 88. The first port 86 and the second port 88 are connected to a supply of a fluid having pumps or pressure tanks controlled by the electronic control unit 44 so as to control the ingress and egress of fluid into the first port 46 and the second port 88.

The first inlet 58 of the first tube 50 is connected to a supply 90 of a purging gas. The second inlet 70 of the second tube 54 is connected to a supply 92 of a product to be packaged within the pouch 12.

The supply 90 is a supply of compressed purging gas. The purging gas is optionally an inert gas such as nitrogen ($N_2$) or carbon dioxide ($CO_2$), although other gases operable to purge oxygen remaining in the pouch 12 and avoid spoilage of the product are applicable. Each of the supply 90 of the purging gas and the supply 92 of the product individually actuated discharge mechanisms 90*a* and 92*a*, respectively, such as pumps, check valves, or the like which are controlled by the electronic control unit 44. In the illustrated embodiment the first material 90.

A flange 94 extends from the exterior of the first tube 50, and a flange 96 extends from the exterior of the actuator case 74. A pair of struts 98 extend between the flange 94 and the flange 96 so as to provide a rigid connection between the first tube 50 and the actuator case 74. Connectors 100 connect the diving nozzle 46 to the vertical displacement mechanism 48.

With reference to FIG. 4, the distal end 64 of the second tube 52 is formed with a stopper 102. The stopper 102 includes a generally frustoconical shape having a lower base portion 104 and a frustoconical shaped portion 106 extending between the cylindrical base portion 104 to the second tube 52. The cylindrical base portion 104 has an outer diameter that corresponds to the inner diameter of the distal end 54 of the first tube 50. When the second tube is in the retracted position, as seen in FIG. 3, the stopper 102 acts as a seal to close the first port of the first tube 50.

In order to facilitate a better understanding of the inventive diving nozzle 46, the operation of the fill-purge operation at the fill-purge station 30 will now be explained. Once a pouch 12 has been rotated by the rotating turret 20 to the fill-purge station 30, the vertical displacement mechanism 48 lowers the entire diving nozzle 46 from the raised position, as seen in FIG. 2, to the lowered position, as seen in FIG. 1, in the direction of arrow A1. The electronic control unit 44 controls the vertical displacement mechanism 48 to vertically displace the entire dive nozzle 46 from the raised position to the lowered position.

Upon reaching the lowered position the electronic control unit 44 controls discharge mechanism 92*a* of the supply 92 of product 108 to enter the second inlet 70 and extends through the second tube 52 to the second outlet 66 so as to dispense the product 108 into the interior of the pouch 12. The product 108 is preferably a liquid product which is to be packaged in the flexible pouch 12. Upon completing a dispensing of a predetermined amount of the product 108, the electronic control unit 44 controls the discharge mechanism 92*a* to stop the dispensing of the product 108.

Immediately after, or just prior to the completion of the dispensing operation (filling operation), the electronic control unit 44 actuates the actuator 72 by controlling the pumps or pressure tanks so as to supply a fluid in the direction of arrow A4 into the first port 86 so as to move the piston 84 in the direction of arrow B1 which displaces the shaft 80 and the second tube 52 from the retracted position, as seen in FIG. 3, to the extended position as seen in FIG. 4. Any fluid disposed on the opposite side of the piston 84 is discharged through the second port 88 in the direction of arrow A5.

As the actuator 72 moves the second tube 52 from the retracted position to the extended position, as seen in FIG. 4, the vertical displacement mechanism 48 begins to move the entire dive nozzle 46 from the lowered position towards the raised position. During the ascent of the diving nozzle 46 the electronic control unit 44 controls the discharge mechanism 90*a* to dispense the purging gas 110 from the supply 90 to enter the first inlet 58 and extend through the first tube 50 and exit the first outlet 55. As the stopper 102 has been moved from the retracted position, which closes off the first outlet 55, to the extended position which opens up the first outlet 55, the purging gas 110 is dispensed from the first outlet 55 at the first distal end 54 of the first tube 50.

As the stopper 102 is formed with the frustoconical shaped portion 106, the purging gas dispensed from the first outlet 55 is deflected off the frustoconical shaped portion 106 of the stopper 102 and is diffused throughout the interior of the pouch 12 so as to purge any remaining oxygen.

Once the diving nozzle 46 has been moved from the lowered position to the raised position, the electronic control unit 44 controls the pumps or pressure tanks such that fluid enters the second port 88 in the direction of arrow A7. The pressure pushes the piston 84 in the direction of arrow B2 and any remaining fluid contained in the opposite side of the case 74 is exited through the first port 86 in the direction of arrow A8.

It is appreciated, of course, that the supply 90 is optionally a product 108 which is dispensed through the first outlet when the diving nozzle 46 is in the lowered position with the second tube 52 in the extended position. After filling of the pouch 12 with a predetermined amount of product 108, the actuator 72 actuates the second tube 52 from the extended position to the retracted position so as to close off the first outlet 55 to prevent any further discharge of the product 108. Once the second tube 52 has been positioned in the retracted position, the electronic control unit 44 optionally discharges a purging gas 110 contained in the supply 92 through the interior of the second tube 52 through the second port 66. The discharge of the purging gas 110 which will purge any remaining oxygen from the interior of the pouch 12.

In such an embodiment in which the supply 90 is a product for packaging, the electronic control unit 44 optionally actuates the discharge mechanism 90*a* so as to fill the interior chamber of the hollow first tube 50 such that upon actuation of the actuator 72 to move the second tube 52 from the retracted position to the extended position the predetermined amount of product 108 contained within the first tube 50 is dispensed.

Alternatively, the diving nozzle 46 actuates the second tube 52 from the retracted position to the extended position and simultaneously discharges a product 108 from the supply 92 through the second outlet 66 of the second tube 52 while the purging gas 110 from the supply 90 is discharged through the first outlet 55 at the open distal end 54 of the first tube 50. The simultaneous filling and purging operation allows for an increase in filling and purging efficiency as the time required for the pouch to undergo the filling and purging operation is reduced.

It is appreciated, of course, that many modifications and variations of the present specification are possible in light of the above teachings and may be practiced other than as specifically described. It is therefore to be understood that the terminology used is intended to be in the nature of words of description rather than limitation. The present specification has been described thus in an illustrative manner.

It is claimed:

1. A diving nozzle for filling a product into a package and for purging the package with a purging gas, the diving nozzle comprising:

a first tube having a first inlet and a first outlet, the first inlet connected to a supply of a first material, and the first outlet operable to dispense the first material into the package, the first material being one of the product and the purging gas;

a second tube moveable with respect to the first tube, the second tube having a second inlet and a second outlet, the second inlet connected to a supply of a second material, the second outlet operable to dispense the second material into the package, the second material being the other of the product and the purging gas; and a fluid controlled actuator having a shaft and a piston slidingly received within a case, the shaft having one end secured to the second tube and an opposite end secured to the piston, the fluid controlled actuator operable to displace the second tube through a control ingress and egress of a fluid into the case.

2. The diving nozzle of claim 1, wherein the fluid controlled actuator is a pneumatic actuator.

3. The diving nozzle of claim 1, wherein the first material is the purging gas and the second material is a liquid product.

4. The diving nozzle of claim 3, wherein the second tube is at least partially received within the first tube and the second tube extends coaxially with the first tube.

5. The diving nozzle of claim 4, wherein the second tube is moveable with respect to the first tube so as to displace the second tube between an extended position and a retracted position, in the retracted position a distal end of the second tube is received within a distal end of the first tube to close the first outlet, and in the extended position the second tube is displaced relative to the first tube to space the distal end of the second tube from the distal end of the first tube to open the first outlet of the first tube.

6. The diving nozzle of claim 5, wherein the first material is prevented from being discharged when the second tube is in the retracted position.

7. The diving nozzle of claim 6, wherein the distal end of the second tube is formed having a stopper adjacent the distal end of the second tube, the stopper seals the first outlet when the second tube is in the retracted position.

8. The diving nozzle of claim 7, wherein the stopper includes a base portion having an outer diameter corresponding to an inner diameter of the distal end of the first tube.

9. The diving nozzle of claim 8, wherein the stopper has a generally frustoconical shaped portion positioned above the base portion, and when the second tube in in the extended position and the first material dispensed from the first outlet, the first material contacts the frustoconical shaped portion of the stopper to diffuse the first material into the package.

10. The diving nozzle of claim 9 further comprising a vertical displacement mechanism that vertically displaces the diving nozzle between a raised position and a lowered position, in the raised position the distal end of the first tube and the distal end of the second tube is positioned above an open end of the package, and in the lowered position a portion of the first tube and a portion of the second tube extend into the package.

11. The diving nozzle of claim 10, wherein upon displacement of the diving nozzle into, by the vertical displacement mechanism, the second material is dispensed through the second outlet, and wherein upon movement of the diving nozzle from the lowered position towards the raised position and movement of the second tube from the retracted position to the extended position the first material is dispensed through the first outlet.

* * * * *